US012495884B2

(12) United States Patent
Scott et al.

(10) Patent No.: US 12,495,884 B2
(45) Date of Patent: Dec. 16, 2025

(54) STRAP ADJUSTMENT DEVICE FOR A BACKPACK

(71) Applicant: Ergopak Limited, London (GB)

(72) Inventors: Hannah Scott, London (GB); Chris Lewis, Cardiff (GB)

(73) Assignee: Ergopak Limited (GB)

( * ) Notice: Subject to any disclaimer, the term of this patent is extended or adjusted under 35 U.S.C. 154(b) by 56 days.

(21) Appl. No.: 18/624,545

(22) Filed: Apr. 2, 2024

(65) Prior Publication Data

US 2024/0349873 A1 Oct. 24, 2024

(30) Foreign Application Priority Data

Apr. 20, 2023 (GB) ..... 2305841

(51) Int. Cl.
*A45F 3/04* (2006.01)
*A44B 11/02* (2006.01)

(52) U.S. Cl.
CPC ..... *A45F 3/047* (2013.01); *A44B 11/02* (2013.01); *A45F 3/042* (2013.01)

(58) Field of Classification Search
CPC ..... A45F 3/047; A44B 11/125; A44B 11/02
See application file for complete search history.

(56) References Cited

U.S. PATENT DOCUMENTS 3,321,120 A 5/1967 Cunningham
4,607,398 A * 8/1986 Faulconer ..... B63C 11/12 2/452
4,795,384 A * 1/1989 Hattori ..... A63B 31/11 441/64
5,988,476 A 11/1999 Olerio
6,684,667 B2 * 2/2004 Young ..... A44B 11/125 70/69
6,898,826 B2 * 5/2005 Draper ..... A63C 9/002 280/14.22
7,032,415 B2 * 4/2006 Young ..... A44B 11/125 70/69

(Continued)

FOREIGN PATENT DOCUMENTS

CN 203828254 U 9/2014
CN 109549332 A 4/2019

(Continued)

OTHER PUBLICATIONS

Combined Search and Examination Report for UK Application No. GB2305841.5 dated Aug. 16, 2023, 7 pages.

(Continued)

*Primary Examiner* — Justin M Larson
(74) *Attorney, Agent, or Firm* — Endurance Law Group PLC

(57) ABSTRACT

A backpack (10) comprises a pair of shoulder straps (16), each including a strap adjustment device (17). Each strap is adjustable with a one handed operation by pressing an activation element (18) to release a strap securing element (22) within the device (17). The securing element enables movement of the strap when pulled in a first direction (B) while locking movement of the strap from movement in a second direction (A). The strap (24) includes a ratchet surface (23) that engages with the strap securing element (22).

14 Claims, 2 Drawing Sheets

(56) References Cited

U.S. PATENT DOCUMENTS

| | | | | |
|---|---|---|---|---|
| 7,665,190 | B2 * | 2/2010 | Weng | A63B 33/002 2/426 |
| 7,966,701 | B2 * | 6/2011 | Shiue | A63B 33/002 2/452 |
| 8,707,522 | B2 * | 4/2014 | Shiue | A63B 33/002 24/593.11 |
| 2004/0050893 | A1 | 3/2004 | Ravinett | |
| 2016/0350639 | A1 | 12/2016 | Tere | |
| 2019/0038006 | A1 * | 2/2019 | Woods | A47C 7/029 |
| 2019/0191855 | A1 | 6/2019 | Hong et al. | |
| 2024/0349873 | A1 * | 10/2024 | Scott | A45F 3/042 |

FOREIGN PATENT DOCUMENTS

| | | | | | |
|---|---|---|---|---|---|
| CN | 209846363 | U | | 12/2019 | |
| CN | 212938567 | U | | 4/2021 | |
| EP | 0508270 | A2 | | 10/1992 | |
| EP | 1808092 | A1 | * | 7/2007 | A45F 3/047 |
| EP | 4449944 | A1 | * | 10/2024 | A45F 3/042 |
| FR | 2668041 | A1 | * | 4/1992 | A44B 11/14 |
| GB | 2629194 | A | * | 10/2024 | A45F 3/042 |
| JP | 2012148064 | A | | 8/2012 | |
| JP | 2013233171 | A | | 11/2013 | |
| KR | 101128300 | B1 | * | 3/2012 | A45C 13/04 |
| KR | 20130088919 | A | * | 8/2013 | A45C 13/10 |
| KR | 20140069418 | A | * | 6/2014 | A45C 13/10 |
| TW | M594890 | U | * | 5/2020 | |

OTHER PUBLICATIONS

Search Report for UK Application No. GB2035841.5 dated Oct. 27, 2023, 3 pages.

EP Extended European Search Report for Patent Application No. EP24164590.2, issued on Sep. 13, 2024, 9 pages.

UK Grant Notice for Patent Application No. GB2305841.5, issued on Jul. 29, 2025, 2 pages.

UK Second Examination Report for Patent Application No. GB2305841.5, issued on Feb. 18, 2025, 5 pages.

* cited by examiner

STRAP ADJUSTMENT DEVICE FOR A BACKPACK

CROSS REFERENCE TO RELATED APPLICATIONS

This application claims priority to UK Patent Application GB 2305841.5 filed on Apr. 20, 2023, the entire disclosure of which is hereby incorporated by reference and relied upon.

TECHNICAL FIELD

The present disclosure relates to a backpack and novel aspects of components used for constructing a backpack, particularly a strap adjustment device.

BACKGROUND

Backpacks are a common portable storage solution, i.e. a means of carrying belongings between locations, such as home and school, or for general travel. Backpacks are effectively a form of bag with one or more storage compartments and shoulder straps, often designed for use by different age groups, where features will be tailored to those age groups. For example, a children's backpack may have bright colours/graphics and large zip openers; compared to, say, a hiking pack which may have complex strap adjustments to configure it for comfortable use by a range of body types.

An aspect of consideration in a backpack, particularly for a child, is to enable a simple means of adjusting the shoulder strap. The conventional method of adjusting a strap on a backpack (adult or child) is use of a friction-based buckle where a strap is shortened by pulling a leading end of the strap further through the buckle, thereby lengthening the leading end but shortening an end fixed to a base of the pack, and locking it by friction as it is threaded back upon itself and/or the general weight of the pack pulling in the opposite direction. A strap shortening function can be achieved by a one-handed operation, i.e. one hand for each strap to be shortened/tightened simultaneously. However, the strap can usually only be lengthened/enlarged in the opposite direction by a two-handed operation of loosening a loop of material at the buckle and allowing the leading end to be shortened relative to the buckle, while lengthening the end fixed to the pack. Such a procedure is complicated to execute by a child, and it can present a frustration to adults also.

Other features commonly found in backpacks include: multi-compartment designs, e.g. separate pockets or accessible cavities, in addition to a large main compartment; and backplates which provide a stiffening function for a rear wall of the pack surface which is, in use, in contact with a user's back. Such features are embodied in many different ways, each having various advantages or disadvantages depending on the design considerations and end-use scenario. Examples of backpacks and/or strap adjustment devices are disclosed by patent publications: CN109549332A, JP2013233171A, CN212938567U, CN209846363U and U.S. Pat. No. 4,795,384A.

One issue that is often considered, but rarely solved, is the effect of a backpack on posture. In other words, backpacks are adjustable for optimizing the comfort of the user, but there is no guarantee that the user, particularly a child, will maintain a correct and healthy posture while wearing the backpack.

BACKGROUND

The invention seeks to address the above shortcomings and identified issues or at least provide a novel alternative to the public.

In a broad aspect of the invention the strap adjustment device includes: a housing for receiving a strap threaded therethrough; a strap securing element engageable with the strap and configured for enabling movement of the strap when pulled in a first direction while locking movement of the strap when pulled in a second direction; an activation element for actuating the strap securing element to release locking of the strap for movement in the second direction, thereby enabling a one-handed operation to adjust a relative position of the strap threaded through the housing in either direction; and a guide pin or wheel for engaging with the strap to divert the direction thereof, and located within the housing beyond where the strap is engageable with the securing element.

In another expression, by way of example, a strap adjustment device for a backpack may comprise: a housing (or support frame) for receiving a strap passing therethrough to travel around a pin or wheel which changes its direction of movement; a strap securing element configured for enabling movement of the strap when pulled (e.g. above a threshold force) in a first direction and locking movement of the strap when pulled (e.g. by any reasonably available force) in a second direction; an activation element for actuating the strap securing element to release locking of the strap for pulling in the second direction; thereby enabling a one-handed operation to adjust the relative position of a strap passing through the housing in either direction. In this way a user, such as a young child, is provided with a mechanism by which a shoulder strap of a backpack can be adjusted by one handed operation, e.g. by pulling a first end of the strap through the housing in the first direction to shorten/tighten a wearing position; or releasing the strap securing element, by activating the activation element at the same time as pushing outwardly on the housing to enable the shoulder strap to lengthen/loosen a wearing position.

In embodiments, the activation element may be a press button, accessed externally on the housing, for acting on the strap securing element within the housing. In this way, a press button operation is intuitive for a user.

In embodiments, the strap securing element is resilient and biased to apply a friction force against a surface of the strap. In this way, the friction force is the normal operating state (i.e. a first state), said friction force being releasable by the activation element against the resilient bias to a second unlocked state.

In embodiments, the strap includes surface features for interfacing with the strap securing element. The surface feature may be a ratchet surface having an abutment face and a sloped surface.

In some forms, the surface features may face away from the activation element. In this way the surface features may be hidden from frontal view, e.g. as the strap passes around the pin or wheel.

As mentioned, the housing is configured to direct the strap therethrough around a pin or wheel. In this way, the strap may exit the housing from the same direction it enters, i.e. a leading end of the strap doubles back on itself.

In embodiments, the strap is formed from a non-self-supporting length of material, i.e. it is not rigid and relatively flexible, in combination with surface feature formed of a harder material. In this way, the substantive strap length may be flexible in the longitudinal direction, e.g. to be fed through the housing of the adjustment device and around a pin or wheel, while having hard surface features configured to interface with the strap securing element, i.e. by way of a ratchet function.

In embodiments or further aspects, a backpack is provided. The backpack may feature a shoulder strap fitted with an adjustment device as outlined above. The backpack may, in some forms, comprise: a back wall; a first compartment accessible by a first opening; and a second compartment, e.g. accessible by a second opening; wherein the first compartment is located above the second compartment and a dividing wall therebetween comprises a sloped floor, such that items stored within the first compartment are urged toward the back wall. In this way, a center of gravity of the backpack is established closer to a user's body, being in contact or adjacent the back wall. It will be generally appreciated that the floor of the first compartment is sloped, compared to a flat base of the backpack overall. In certain forms, the second compartment may be functionally replaced by a wedge of material which provides a sloped surface. Whether in the form of a wedge of compartment, the narrow/pointed end of the wedge should be at a forward facing base end of the backpack. In this way, the volume of the main compartment is maximized, while still having a sloping floor for urging items in a forward direction center of gravity of the backpack closer to a user's body.

In one form, as alluded to above, a floor of the second compartment and/or backpack is configured to be flat, relative to the sloped floor of the first compartment, such that the backpack can be placed on a ground surface and maintained in an upright position, i.e. wherein the back wall is substantially vertical. The second compartment, having a sloped roof and flat floor, may be integrated with a correspondingly shaped rigid container, e.g. a lunchbox.

In embodiments or further aspects, a backplate for a backpack is provided. The shoulder straps of the back pack may be attached at an angle corresponding to an angle of a user's shoulders, e.g. proximate an upper end of the backplate. The backplate is preferably comprised of a rigid self-supporting element, e.g. selected according to body size of a user and/or derived from anatomical data. The backplate may be shaped with a lumbar convex curve portion, transitioning to an upper back concave portion, transitioning to a terminal portion for projecting above the base of a user's neck and/or proximate where shoulder straps are connected to the body of the backpack. The backplate preferably copies and accommodates a spinal shape of the intended user. The back plate may be substituted for different dimensions of user. The back plate may be one piece or a composite of foam and/or rigid pieces/layers. Particularly, the back plate may feature a curved face as outlined above, configured to contact against a user's back, and a substantially flat face (e.g. in a vertical direction) on the opposite side, which faces toward the main compartment of the backpack. In this way, comfort may by provided to a wearer, while items such as books or a laptop within the backpack will press against the flat face of the backplate only and not influence curvature thereof which is intended for comfort and wearability.

In embodiments or further aspects, a backpack is provided incorporating posture indicator means for prompting a user to adopt correct posture. Such an indicator means may be a command "stand up tall/straight!" or similar, written in bold letters. In a further aspect, a method of attaching a shoulder strap to a back pack is disclosed herein. For example, by attaching a bracket to a distal free end of a shoulder strap and inserting it through an opening or slot formed through the backplate and/or moulding associated with back support for the user. Once through the slot, the bracket is reoriented to prevent the strap from returning back through the slot. The back plate/moulding may feature a recess in which the bracket can be retained. It is also noteworthy that the slot and hence straps can be angled to conform with a shoulder contour of a user. Support for the angle of the shoulder strap may be provided by the back plate formation itself.

BRIEF DESCRIPTION OF THE DRAWINGS

The drawings that accompany the detailed description can be briefly described as follows.

DETAILED DESCRIPTION

The following description presents exemplary embodiments and, together with the drawings, serves to explain principles of the invention. However, the scope of the invention is not intended to be limited to the precise details of the embodiments or exact adherence with all features and/or method steps of implementation, since variations will be apparent to a skilled person and are deemed also to be covered by the description. Terms for components used herein should be given a broad interpretation that also encompasses equivalent functions and features. In some cases, several alternative terms (synonyms) for structural features have been provided but such terms are not intended to be exhaustive. Comparable synonyms are sometimes referred to separated by "/" which is merely a way to alternatively express the same or equivalent feature. Synonymous terms can be used interchangeably, such as for revision of terms in the claims. Descriptive terms should also be given the broadest possible interpretation; e.g. the term "comprising" as used in this specification means "consisting at least in part of" such that interpreting each statement in this specification that includes the term "comprising", features other than that, in addition to, or those prefaced by the term may also be present. Related terms such as "comprise" and "comprises" are to be interpreted in the same manner. Use of an directional terms such as "vertical", "horizontal", "up", "down", "sideways", "upper" and "lower" are used for convenience of explanation usually with reference to the orientation shown in illustrations and are not intended to be ultimately limiting if an equivalent function can be achieved with an alternative dimension and/or direction. Therefore, all directional terms are relative to each other.

The description herein refers to embodiments with particular combinations of steps or features, however, it is envisaged that further combinations and cross-combinations of compatible steps or features between embodiments will be possible. Indeed, isolated features may function independently as an invention from other features and not necessarily require implementation as a complete combination. This is particularly noteworthy since features such as the sloped floor of the main compartment, back plate configuration, nature of and method of shoulder strap connection to the back pack, and posture prompt are not technically interdependent with the strap adjustment device. Indeed, the strap adjustment device may have application in a field separate from backpacks entirely.

It will be understood that the illustrated embodiments show applications only for the purposes of explanation. In practice, the invention may be applied to many different configurations, where the embodiment is straightforward for those skilled in the art to implement and does not necessarily depart from the essence of the invention as outlined by the appended claims.

Figure 1:
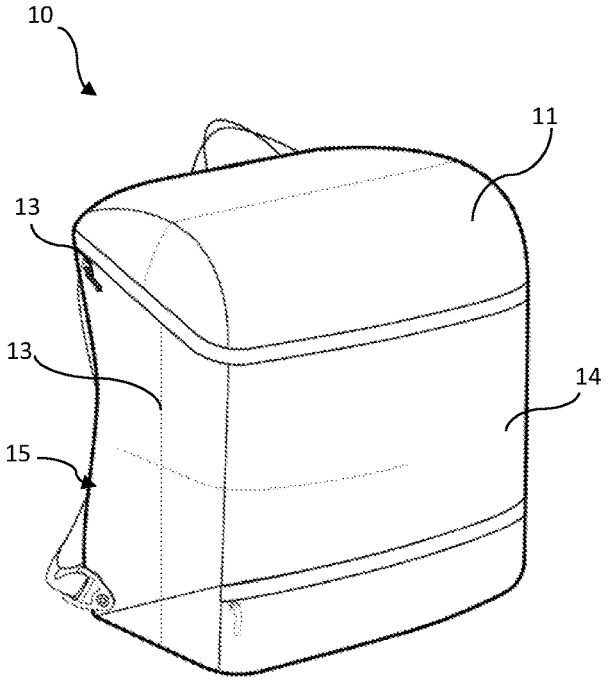
FIG. 1 illustrates a frontal overview of a backpack according to an embodiment described herein where compartment openings are visible.
Figure 2:
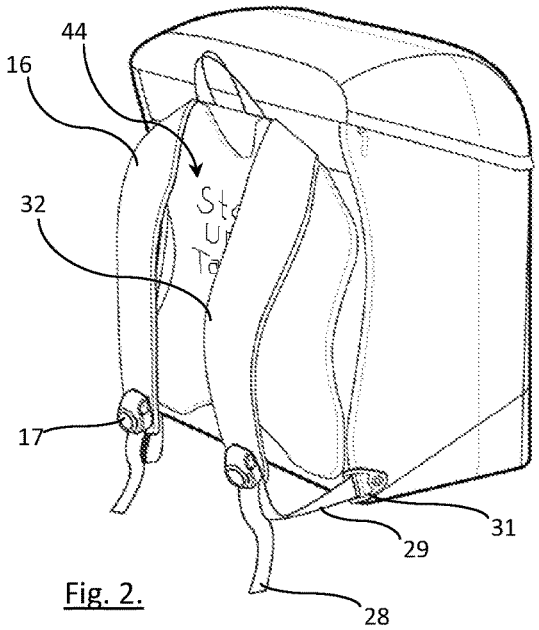
FIG. 2 illustrates a rear overview of a backpack, where shoulder straps are visible.

FIGS. 1 and 2 show a backpack 10 which broadly embodies the invention(s) of the present disclosure. The backpack 10 shown in FIG. 1 has identifiable features such as a flap-style lid 11, a zip fastening closure 12 for lid 11, side walls 13, a front wall 14, a rear/back wall 15 which, in use, faces/contacts the body of someone wearing the backpack. FIG. 2 shows the other side of a backpack 10, where a pair of shoulder straps 16, 32, each having an adjustment device 17, are visible. Variations are possible, such as a clip-fastened opening across the upper surface for providing access, along with additional zip-operated pockets.

Figure 3:
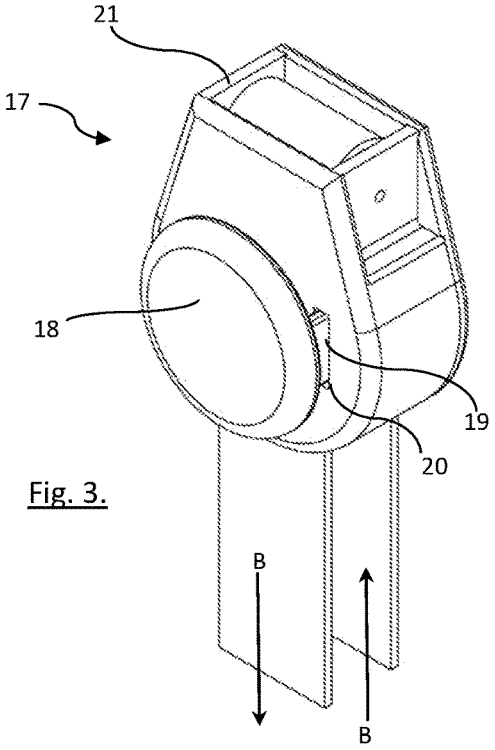
FIG. 3 illustrates a frontal perspective view of a strap adjustment device.
Figure 4:
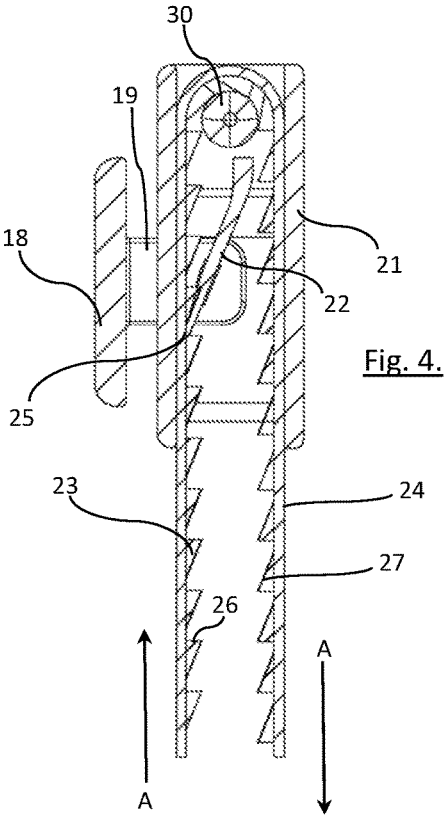
FIG. 4 illustrates a side view of the strap adjustment device, showing a section taken longitudinally down a center line of the view from FIG. 3.

A particularly unique feature of the backpack 10 is the form of strap adjustment device 17, best shown in FIGS. 3 and 4. Specifically, according to the section detail of FIG. 4, an activation button comprised of a hand/finger plate 18 and two legs 19, extends through slots 20 in a housing 21 to actuate an abutment/stop element 22 which serves as a strap securing element to alternatively disengage/engage from teeth 23 protruding from an internal surface of a strap 24.

Stop element 22 is a length of material that is resiliently biased toward engagement and applying friction force against teeth 23, e.g. where the position of strap 24 is locked from movement in the direction of arrows A (FIG. 4). Since movement in the direction of arrow A is prevented by any reasonably available force, only manually pressing button 18 will disengage an engagement end 25 of stop element 22 from a locking wall 26 of a tooth 23 to release strap for movement in direction A. In the illustrated form an end of stop element 22, distant from engagement end 25, is fixed within housing 21 and the substantive length is resiliently flexible to be actuated by contact with an abutment feature on one or both legs 19.

It will be apparent that longitudinal strap movement in a reverse direction to arrows A (e.g. arrows B shown in FIG. 3) will be possible at any time by simply pulling strap 24 in that reverse direction, by virtue of the sloping wall 27 of tooth 23 or if the stop element 22 is disengaged. A minimum threshold force will be necessary to overcome the bias of stop element as it slides over sloping wall 27, but such force is within the capabilities of a child. However, the friction/bias force ensures that the strap is locked in the A direction when button 18 is not depressed.

The disclosed ratchet style solution enables one handed operation of strap adjustment during both lengthening and shortening operations. Specifically, in the context of a backpack 10, the shoulder strap length can be shortened (i.e. to bring the bag closer/tighter to a user's body) in the conventional way by pulling a frontally located leading/free end 28 of strap 24 downwards in direction B (overcoming a minimum threshold force of element 22 to move over surface 27), to lengthen it relative to the device 17 while effectively shortening the length of strap at the trailing end 29, relative to the device 17, which is attached to a base of the backpack 10, e.g. via a swivelable anchor plate 31. Conversely, the shoulder strap (16/32) of a backpack 10 can be lengthened (i.e. move the bag away from/looser with respect to a user's body) by pressing button 18, thereby disengaging stop element 22, and pushing the device 17 outwardly from the body. Both devices 17 of the shoulder straps can be actuated simultaneously. Since teeth 23 are disengaged, strap 24 is free to move in the direction A, which effectively shortens the leading/free end 28 of strap 24, while trailing end 29 lengthens relative to its fixed position at the base of pack 10 and the where it passes through device 17 and around a bar 30.

The adjustment device 17 can be generally described as utilizing a ratchet strap 24 threaded from the back of clip and doubled back to the front around a wheel/bar 30. Toward the front there is a lever/stop element 22 which catches on the ratchet and stops the strap slipping backwards. Accordingly, the overall strap can be tightened with one hand, e.g. by a four-year old, by simply pulling the end of the strap.

When pressed, the button 18 on the front of the clip pushes the lever 22 off the ratchet 23, e.g. via an extending leg that engages an edge of the stop element, which is resilient so that, when force is released, it springs back (e.g. by virtue of resilient material of element 22) to a locked position. With one hand a child can hold down on the button with their fingers and put their thumbs at the back of the clip to be able to push the clip forward, thus loosening the overall strap to a larger size.

Adjustment/ratchet device 17 may be utilized in various applications, but in the embodied context of a backpack, housing 21 may include an extension buckle or bar to attach same to a bottom end of shoulder strap (16, 32), e.g. for securing the adjustment device to the webbing of a padded shoulder 32 in a conventional way, e.g. by stitching a length of webbing in place to provide sufficient strength over the life of the backpack 10.

Figure 5:
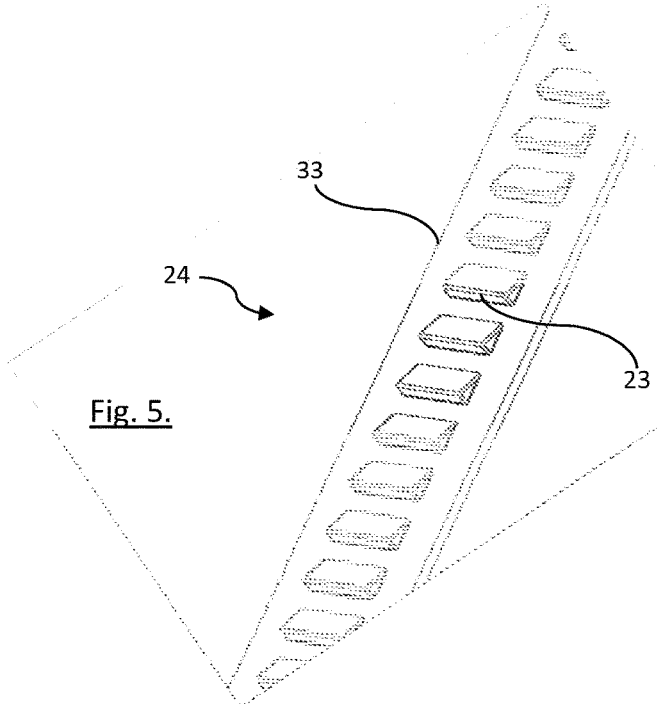
FIG. 5 illustrates a perspective overview of a strap for use with the adjustment device.

FIG. 5 shows a perspective view of a length of strap 24, suitable for use with the adjustment device 17. Particularly, strap 24 is intended to be made substantively from flexible material 33 so that it can pass into housing 21 and be threaded relatively tightly around guide pin/bar 30. The smallest travelling radius of strap 24 at pin 30 (see FIG. 4) is determined by the thickness of strap 24 and the extent to which teeth 23 protrude from its surface, facing pin 30. In the illustrated form, the ratchet surface of teeth 23 is hidden (from a frontal view) on the inner surface of strap 24, but the configuration could be reversed, i.e. such that the ratchet surface is on the outside, which may practically require the release mechanism to be modified, however, the function of pressing down a button to release/unlock a ratchet mechanism should be maintained.

In any event, the strap 24 may comprise novel qualities, e.g. a flexible length of material 33 supplied with hard teeth 23 or equivalent surface features protruding therefrom. In this way, flexibility is maintained without compromising the strength of the locking mechanism. Such a construction likely requires two different (or different grades of) materials to comprise the substantive strap length/width and the teeth 23. The strap 24 of the present disclosure is distinct from a ratchet strap/length that is made entirely from hard plastic and relatively self-supporting such as that of a ski-boot. In other words, the present strap is relatively floppy, not self-supporting, and features hard teeth surface features with a locking face and sloped/release surface.

Alternative constructions may be possible such as a plurality of rectangular openings or indentations in series along the strap 24, with hard edges to serve as a locking surface 26. In this way, a strap could be pulled in one direction (B) against the bias of element 22 but locked from pulling in the other direction (A) unless the element 22 is disengaged. A strap with multiple openings or indentations on its surface could be engaged with a toothed wheel/cog or flat brake surface within the housing that is lockable in one or both directions.

The strap may involve a novel means of production, such as over-moulding the hard teeth 23 to a softer fabric or like strap surface.

Figure 6:
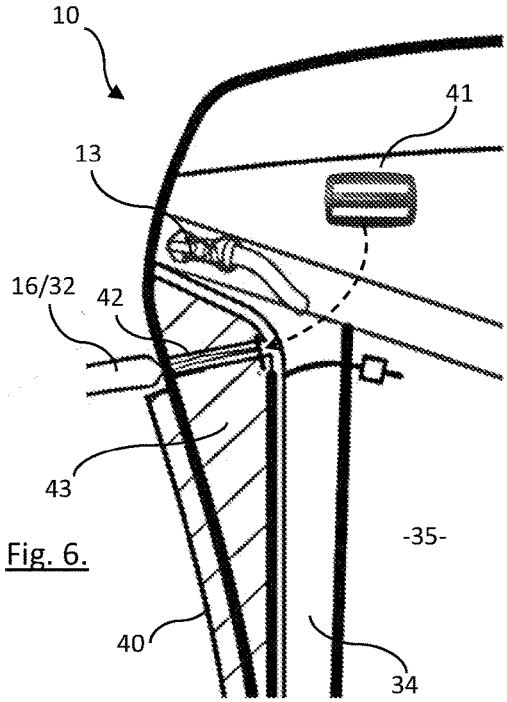
FIG. 6 illustrates a side detail view of an upper portion of the backpack, showing internal detail of shoulder strap attachment.
Figure 7:
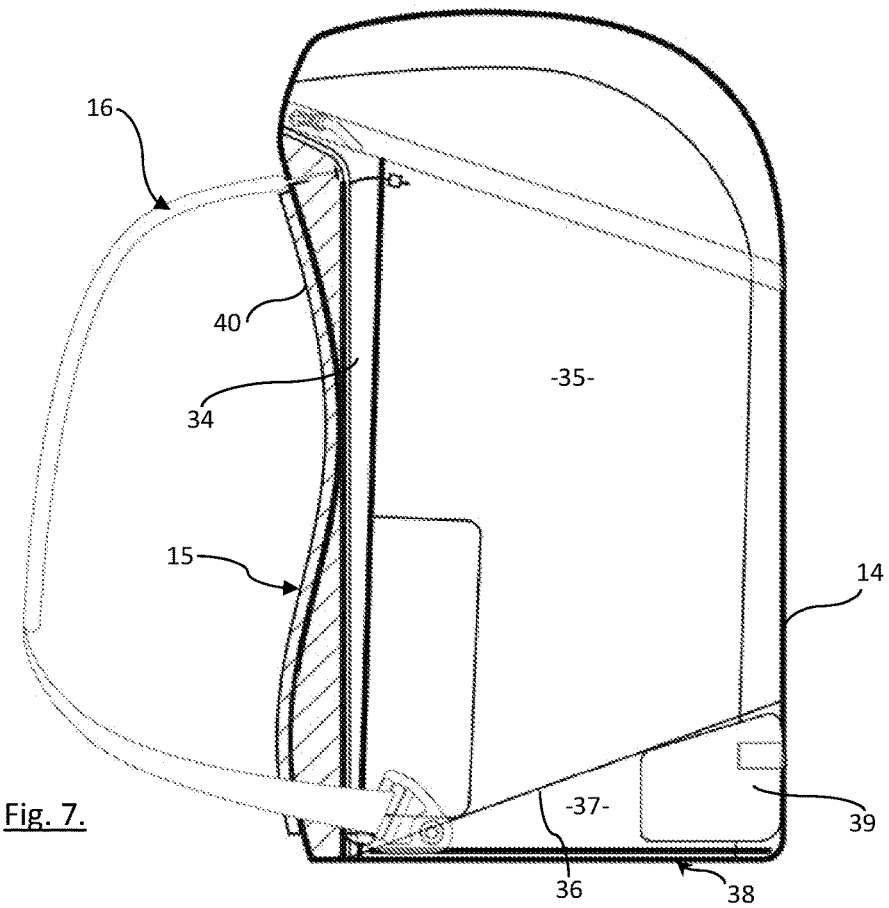
FIG. 7 illustrates a side section view of the backpack, showing a curve of a backplate and internal components.

FIGS. 6 and 7 illustrate a detailed side view of the backpack 10 where multiple compartments are visible; e.g. a long/wide compartment 34 closest to the body for heavy items such as a laptop and/or books, and a main/first compartment 35 that may feature an elastic net for holding a water bottle and/or other items. In this way, the heaviest items are mid-pack or closest to the body for best balance/weight distribution.

In the illustrated form of FIG. 7, central compartment 35 has a sloping floor 36, downwards from front wall 14 toward the back wall 15, such that the content of this compartment (35) will be urged towards the user's body. The angle of the floor 36 may vary from what is shown, e.g. having a steeper or gentler angle. The range of angles is preferably 10 to 45 degrees, most preferably 15 to 30 degrees.

At a base of the backpack 10, underneath the compartment 35, a wedge-shaped compartment 37 may be located, e.g. for accommodating a lunch box 39 at a frontal portion thereof. In the preferred form, the sharp end of the wedge of compartment 37 terminates at the base, thereby maximizing the volume of compartment 35 while providing the rearward (towards back of user) urging function for contents. Such a configuration is relatively counterintuitive because the lower compartment 34 is quite small. Container 39 may have a corresponding shape to that of compartment 37 and, therefore, provide rigidity thereto. In other words, a rigidity may be applied to floor 36 by a hard-shelled container, or a strengthening plate/ribs. The wedge-shaped compartment 37 may be shaped so that the outer/lowermost floor 38 of the backpack is flat, i.e. maintaining an overall square or box-type shape. In this way, the backpack may be configured to stand upright when put down on a table or ground surface despite the sloping floor of the main compartment. The ability for the backpack to stand upright will make accessing the content of the bag easier for children, as less bending down may be needed and hence better for dynamic posture.

FIG. 7 particularly illustrates a preferred profile of a rear wall 15 of the back pack, e.g. implemented with a back plate 40 which may be made in different sizes such as large, medium and small. A selection of sizes may accommodate the length and width of a range of users (e.g. children) at different ages/dimensions. Preferably, each size will have a characteristic S shape which follows the angles of kyphosis and lordosis for each age group/range, e.g. based on an average of anatomical data. In one form, back plate 40 may be relatively rigid and include a backing moulded portion 43, e.g. of less rigid filling material. In any event, the moulding 43 (which could be unitary with plate 40) should include a flat front-facing surface adjacent pocket 34. In this way, a laptop or book slotted into pocket 34 will not deform back plate 40 and neither will the back plate 40 deform the pocket 34. The back plate and/or moulded piece 43 may be replaceable. Parts of the back plate support may be compression moulded or formed by any other suitable process.

As best illustrated by FIG. 6, the backpack itself includes a portion that extends above the level of the shoulder straps, where they join to the back pack. The overextending feature is implemented so that the main weight of the bag is held at the level of the thoracic spine, to strengthen the longitudinal muscles down each side of the spinal column and to pull the shoulders back gently. The illustrated form provides a configuration where the strap acts like a hook over the shoulders. It is also noteworthy that the upper portion of the backpack, e.g. the lid portion defined above the zip 13, is shown to be overhanging a scooped/recessed part of the rear side 15 which accommodates moulded portion 43. In this way, internal volume is maximized, while the curved-on-one-side-flat-on-the-other back plate is accommodated.

A novel method of attaching a shoulder strap 16 can also be understood by reference to FIG. 6. The method deviates from more conventional constructions where an existing seam is utilized to sew in a shoulder strap. The method utilizes a tri-bar, or similar bracket, 41 attached to a distal free end of each shoulder strap during assembly thereof that is flattened for insertion through an opening edge/slot 42 formed through the moulding 43 that provides support for backplate 40. Once through the slot, the bracket is unflattened/turned perpendicular to the strap to prevent the strap from returning back through the slot 42. The moulding 43 may feature a recess in which the bracket can sit. It is particularly noteworthy that, as seen in FIG. 2, the fixing area for straps 16, 32 are preferably angled to conform with a shoulder contour of a user. Support for the angle of the shoulder strap may be provided by the back plate 40 itself.

A further aspect considered by the present disclosure addresses neuro visual training, e.g. repetition via visual prompts that can cause the brain to create new habits. According to this theory, a large number of prompts can change an already existing habit. In a simple example, a voice saying "stand up tall," three hundred times can result in the recipient eventually standing up tall on their own.

Accordingly, in one form, a visual stimulus can be incorporated onto the backplate (see example "stand up tall" indicator 44 shown in FIG. 2), straps or elsewhere visible to the user in use or prior to use, to prompt the wearer to stand up tall and improve posture. Since one form of the backpack is aimed at primary school age children, this is the age when they are learning to read and make observations of the world around them. Reading or interpreting a visual prompt will encourage good long term postural behaviour.

By way of summary, a backpack disclosed herein comprises a pair of shoulder straps, each including a strap adjustment device. Each strap is adjustable with a one-handed operation by pressing an activation element, e.g. a button, to release a strap securing element within the device. The securing element enables movement of the strap when pulled in a first direction while locking movement of the strap from movement in a second direction, unless the button is pressed. The strap is generally a soft, easily flexible length, including a relatively hard ratchet surface that engages with the strap securing element.

What is claimed is:

1. A strap adjustment device for a backpack comprising:

a housing for receiving a strap threaded therethrough;

a strap securing element engageable with the strap and configured for enabling movement of the strap when pulled in a first direction while locking movement of the strap when pulled in a second direction;

an activation element for actuating the strap securing element to release locking of the strap for movement in the second direction, thereby enabling a one-handed operation to adjust a relative position of the strap threaded through the housing in either direction; and a guide pin or wheel for engaging with the strap to divert the direction thereof, and located within the housing beyond where the strap is engageable with the securing element;

wherein the activation element is comprised of a press button, accessed externally on the housing, and at least one leg element extending from a side of the press button opposite a finger plate surface, through a corresponding slot in the housing, for engaging with the strap securing element for actuation thereof.

2. The strap adjustment device of claim 1, wherein the strap securing element is configured with a resilient bias to apply a friction force against a surface of the strap.

3. The strap adjustment device of claim 1, wherein the strap securing element comprises an engagement surface for contacting with a ratchet surface of the strap.

4. The strap adjustment device of claim 1, wherein the guide pin or wheel is configured to divert the strap to double back on itself.

5. The strap adjustment device of claim 1, wherein the housing comprises an external over-shoulder strap coupling element for coupling with a second strap length of the backpack.

6. The strap adjustment device of claim 1, in combination with a strap, wherein the strap comprises surface features for interfacing with the strap securing element.

7. The strap adjustment device of claim 6, wherein the surface feature is a ratchet having an abutment face and a sloped surface.

8. The strap adjustment device of claim 6, wherein the surface features face away from the activation element.

9. The strap adjustment device of claim 6, wherein the strap is comprised of a non-self-supporting length of material, and a plurality of surface features formed of a harder material.

10. A backpack comprising a strap adjustment device according to claim 1, incorporated into each of a shoulder strap of the back pack.

11. The backpack according to claim 10, further comprising:

a back wall;

a first compartment accessible by a first opening; and a second compartment accessible by a second opening;

wherein the first compartment is located above the second compartment and a dividing wall therebetween comprises a sloped floor, such that items stored within the first compartment are urged toward the back wall.

12. The backpack of claim 11, wherein the sloped floor is rigid and/or the second compartment is configured to receive a hard-shell container.

13. The backpack of claim 10, comprising posture indicator means for prompting a user to adopt correct posture.

14. A method for adjusting a backpack according to claim 10, comprising the step of:

pulling a first end of the shoulder strap through the housing of the strap adjustment device in the first direction to thereby shorten/tighten a wearing position; or activating the activation element to release the strap securing element, at the same time as pushing outwardly on the housing to enable the shoulder strap to move in the second direction to lengthen/loosen a wearing position.

* * * * *